US007365254B2

(12) United States Patent
Johansson

(10) Patent No.: US 7,365,254 B2
(45) Date of Patent: Apr. 29, 2008

(54) STRINGED INSTRUMENT

(76) Inventor: Fredrik Johansson, Pjäsbacken 35, SE-174 58, Sundbyberg (SE)

( * ) Notice: Subject to any disclaimer, the term of this patent is extended or adjusted under 35 U.S.C. 154(b) by 329 days.

(21) Appl. No.: 10/548,736

(22) PCT Filed: Feb. 25, 2004

(86) PCT No.: PCT/SE2004/000252

§ 371 (c)(1),
(2), (4) Date: Sep. 9, 2005

(87) PCT Pub. No.: WO2004/081914

PCT Pub. Date: Sep. 23, 2004

(65) Prior Publication Data

US 2007/0144328 A1 Jun. 28, 2007

(30) Foreign Application Priority Data

Mar. 12, 2003 (SE) ..... 0300671

(51) Int. Cl.
*G10D 3/00* (2006.01)

(52) U.S. Cl. ..... 84/293

(58) Field of Classification Search ..... 84/290, 84/293, 267, 291

See application file for complete search history.

(56) References Cited

U.S. PATENT DOCUMENTS 4,111,093 A 9/1978 Field et al. ..... 84/267
5,383,385 A 1/1995 Gilbert ..... 84/267
6,353,164 B1 * 3/2002 Corsi ..... 84/293

FOREIGN PATENT DOCUMENTS

DE 148174 A 5/1981
GB 2 363 508 B 12/2001
GB 2365 198 A 2/2002

OTHER PUBLICATIONS

International Search Report PCT/SE2004/000252 dated May 24, 2004.

* cited by examiner

*Primary Examiner*—Kimberly Lockett
(74) *Attorney, Agent, or Firm*—Ostrolenk, Faber, Gerb & Soffen LLP

(57) ABSTRACT

A stringed instrument comprising an instrument belly with a neck extending therefrom, a first attachment means for strings at the free end of the neck, a second attachment means for strings on the belly of the instrument, strings extending across the upper side of the belly and neck between the attachment means and a folding arrangement connecting neck and belly, to permit the neck to be folded between a first operative position and a second inoperative position in which the neck is located above the upper side of the belly. One of the string attachment means comprises a reel rotatably journalled about a shaft located substantially perpendicular to the alignment of the strings. The reel is spring-tensioned about its shaft in order to coil or uncoil the strings in stretched state when the neck is folded from or to operative position.

9 Claims, 2 Drawing Sheets

STRINGED INSTRUMENT

CROSS REFERENCE TO RELATED APPLICATIONS

The present application is a 35 U.S.C. §371 national phase conversion of International Application No. PCT/SE2000/000252 filed Feb. 25, 2004, which claims priority from Swedish patent application No. 0300671-5 filed Mar. 12, 2003.

The invention relates to a stringed instrument of the type described in the preamble to claim 1.

BACKGROUND OF THE INVENTION

The invention thus relates to a stringed instrument in which the neck can be folded in over the belly of the instrument so that, when folded, the instrument requires little transport space.

One problem with stringed instruments of the known type is that, when in folded state, the strings will run in arbitrary tracks between the string attachment means and the string holder. If the instrument is to be kept in a cover or case when folded, therefore, there is risk of the strings being damaged by the zip fastener or by being clamped, or of one of the strings being damaged when the instrument is unfolded to its operative position.

Furthermore, the instrument usually becomes out of tune during folding/unfolding operations so that it must undergo extensive tuning once the neck has been folded out to operative position.

SUMMARY OF THE INVENTION

One object of the invention is therefore the provide a stringed instrument wherein the drawbacks mentioned above are entirely or partly eliminated.

The object is achieved by means of the invention.

The invention is defined in the appended independent claim.

Embodiments of the invention are defined in the appended sub-claims.

The invention has been defined in that the neck of the instrument is connected to its belly via a folding arrangement. However, it should be clear that a small part of the neck may be considered as belonging to the belly of the instrument.

An important feature of the invention is that one or other of the string attachment means is arranged on a rotatably journalled reel extending substantially perpendicularly to the alignment of the strings. The reel is pre-tensioned, spring-tensioned for instance, in order to coil the strings onto the reel when the neck is folded in over the belly or to keep the strings taut while they are being uncoiled from the reel when the neck is folded out from the belly to operative position.

The reel is carried by a fitting on which it is rotatably journalled. The fitting may be connected to a stationary element on the belly or the neck, by means of a tensioning mechanism. In an end position this tensioning mechanism is arranged to hold the fitting at a predetermined distance from the element. The tensioning mechanism is arranged to permit an increase in said distance in order to relieve the strings before the neck is folded to and from its operative position. This avoids extra loads being introduced in the strings during movement of the neck to and from its operative position. In a simple and preferred embodiment the end position of the tensioning mechanism is defined by rigid contact between fitting and element. The tensioning mechanism itself may comprise a screw with a knob, the screw extending through an opening in the element and engaging with a threaded opening arranged opposite it in the fitting.

The folding arrangement may per se comprise a simple hinge, but preferably comprises a four-link mechanism which, in the final stage of the swinging movement, permits the inner end portion of the neck to approach a corresponding recess in the belly to be rigidly supported thereby in the operative end position of the neck. Naturally this also means that the neck is axially displaced from the belly at the start of the folding movement of the neck towards inoperative state, after which the neck describes a combined swinging and displacement movement.

In order to further stabilize the connection of the neck to the belly in operative position a fitting may be arranged between belly and neck, on the lower side of the neck in the region of the joint between belly and neck. A screw extending from the lower side of the belly up through an opening is received in a thread in the lower side of the neck when the neck is in operative position. The screw may be provided with a finger-operated knob and stabilizes the neck in the recess of the belly.

BRIEF DESCRIPTION OF THE DRAWINGS

The invention will be described in the following by way of example with reference to the accompanying drawings.

DESCRIPTION OF A PREFERRED EMBODIMENT

Figure 1:
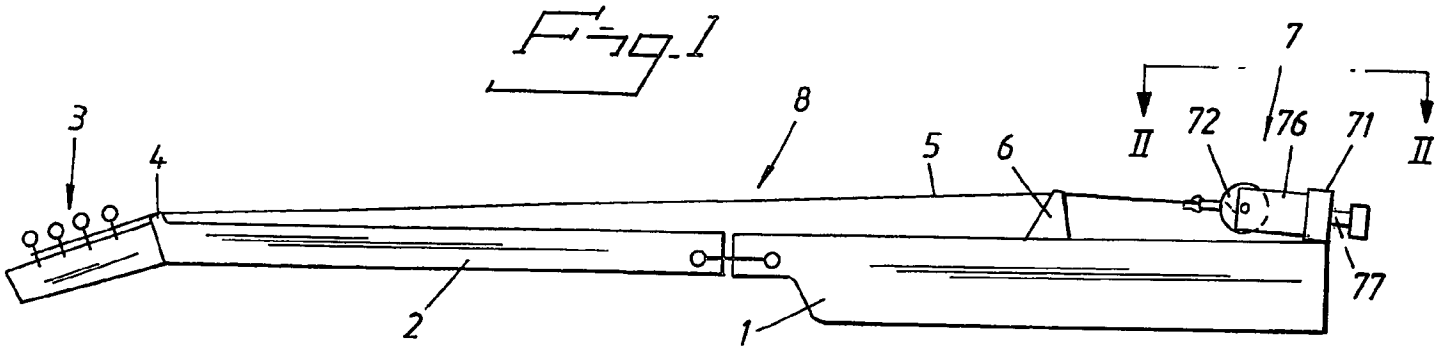
FIG. 1 shows schematically a side view of a stringed instrument in accordance with the invention.

FIG. 1 shows a stringed instrument comprising a belly 1 with a neck extending therefrom and connected to the belly 1 via a folding arrangement 8. The free end portion of the neck 2 is provided with a peg box 3 with tuning pegs for the strings. The strings extend across a nut 4 at the free end of the neck 2. A bridge 6 supporting the strings 5 is provided on the upper side of the belly 1. Opposite the neck 2 is a string holder 7. The peg box 3 and nut 4 form a first attachment means for one end of the strings.

The string holder 7 comprises a reel 72 which is rotatably journalled between the shanks 73 of a generally U-shaped yoke 76, the waist of which rests rigidly against an attachment 71 for the string holder, secured to the belly 1 with the aid of a tensioning mechanism, seen to have a finger-operated screw 77 extending through an opening in the attachment means 71 and pivotably engaging with a threaded bore 79 in the waist of the yoke.

Figure 3:
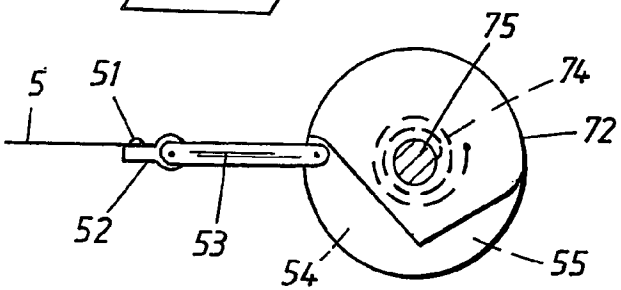
FIG. 3 shows schematically a view in section taken along the line III-III in FIG. 2.
Figure 4:
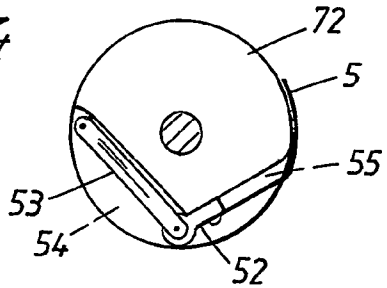
FIG. 4 shows the coiling reel in coiled state.

The string holder forms an attachment for the other ends of the strings. As can be seen in FIG. 3, the reel 72 is pre-tensioned with a spring 74 in relation to a journalling shaft 75 so that the strings 5 will be coiled onto the reel 72 when the neck 2 is folded in over the upper side of the belly 1. When the neck is folded out to operative position the strings will be safely uncoiled against the action of the spring 74.

Figure 2:
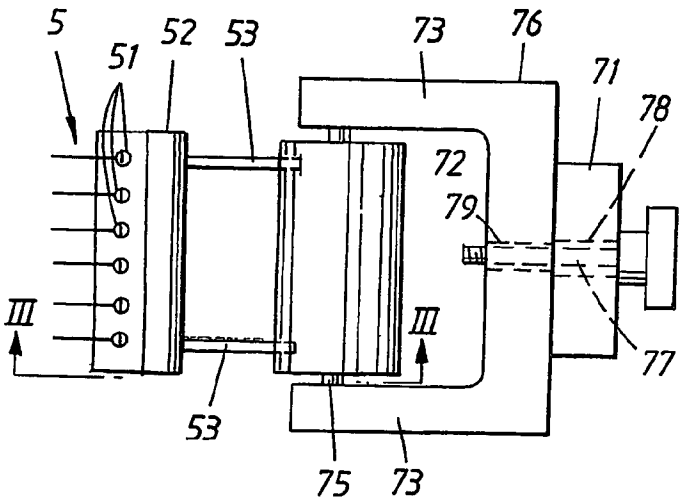
FIG. 2 shows schematically a view taken along the line II-II in FIG. 1.

FIGS. 2 and 3 show that the strings 5 are connected by attachment elements 51 to a bar 52 which is pivotably connected to a pair of parallel lines 53 spaced from each other, which in turn are pivotably journalled in the reel 72. The reel 72 has recesses 54 to receive the links 53. The reel 72 also has a recess 55 able to receive the bar 52. It is clear that the transition between the recess 55 and the periphery of the reel 72 is gentle in order to reduce the strain on the strings 5. It can also be seen in FIG. 3 that in the operative state of the instrument the strings 5 extend substantially radially to the shaft 75 of the reel.

The embodiment can of course be modified so that the reel 72 with its holder 76 is situated at the free end of the neck 2, and the peg box 3 with nut 4 on the belly 1.

As an alternative to the embodiment shown in FIG. 1, the tensioning mechanism 77, 78, 79 may attach the peg box and nut 4 to the neck 2. If the reel 72 and peg box 3 swap places, the tensioning mechanism may of course still be connected to the reel.

Figure 5:
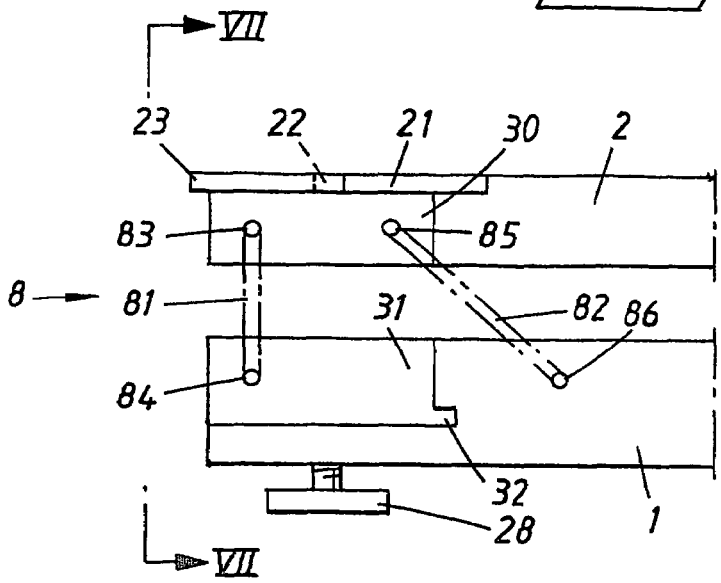
FIG. 5 shows a side view of a folding mechanism folded between the belly and the neck of the instrument.
Figure 6:
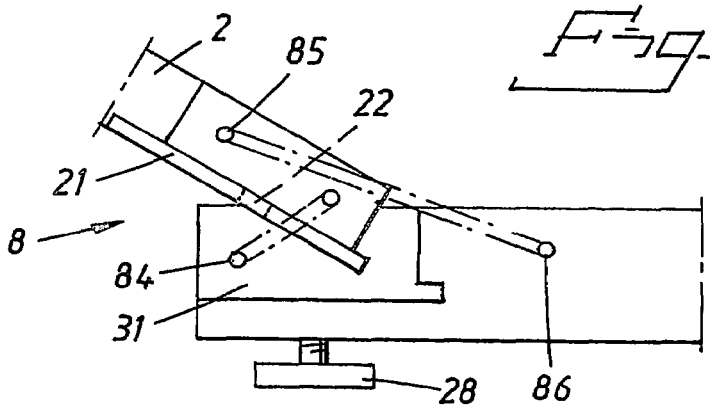
FIG. 6 shows the mechanism in accordance with FIG. 5 at another stage of the folding procedure.
Figure 7:
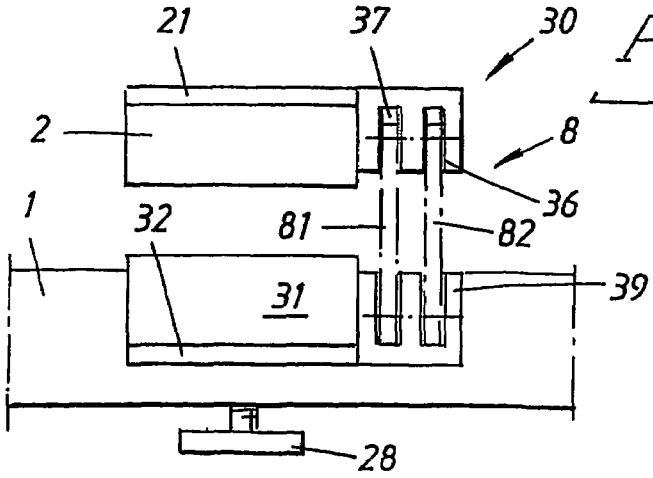
FIG. 7 shows a view taken along the line VII-VII in FIG. 5.

FIGS. 5-7 show a currently preferred embodiment of the folding arrangement 8. In this embodiment the belly 1 is provided with a recess 31 to receive the adjacent end portion of the neck 2. The lower side of the neck 2 is provided with a metal plate 21 extending a short way past the end of the neck 2 to form a securing tongue 23. The plate 21 is also provided with a threaded opening 22.

On one side of the neck 22 is a journalling fitting 30 for bearings 83 and 85 for one end of a link arm 81 and 82, respectively. The link arms 81, 82 are pivotably journalled on the belly 1 at fulcrums 84 and 86, respectively. It can be seen in FIG. 5 that, in folded state, the link arm 81 extends substantially perpendicular to the neck 2, whereas the link arm 82 forms an oblique angle of less than 45 degrees to the longitudinal direction of the neck. As depicted in FIG. 7 the fitting 30 has an upwardly open groove 37 extending along its length, to receive the link arm 81. The fitting 30 also has a groove 36 extending along its length which opens downwardly to receive the link arm 82 when the neck 2 is folded out in relation to the belly 1. The belly 1 is also provided with a recess 39 to receive the fitting 30.

FIG. 6 shows the folding arrangement 8 when the neck 2 forms an angle of around 30 degrees to its operative direction and it can be seen that the arrangement 8 permits the securing tongue 23 to move into a corresponding recess 32 in the forward end of the recess 31.

The belly 1 is also seen to have a bore with a screw 28 directed towards the threaded opening 22 in the plate 21 when the neck is folded out and the plate 21 rests against the bottom surface of the recess 31 so that the screw 28 can be screwed into the opening 22 thereby securing joining the neck and belly 1.

The invention claimed is:

1. A stringed instrument comprising an instrument belly with a neck extending therefrom, a first string attachment for strings at the free end of the neck, a second string attachment for strings on the belly of the instrument, strings extending across an upper side of the belly and the neck between the first and second attachments;

a folding arrangement connecting the neck and the belly to permit the neck to be folded between a first operative position and a second inoperative position, the neck is located above the upper side of the belly in the inoperative position, one of the string attachments comprising a reel rotatably journalled about a shaft located substantially perpendicular to the alignment of the extended strings, and the reel is spring-tensioned about the shaft in order to coil or uncoil the strings in a stretched state when the neck is folded from or to the first operative position.

2. A stringed instrument comprising an instrument belly with a neck extending therefrom, a first string attachment for strings at the free end of the neck, a second string attachment for strings on the belly of the instrument, strings extending across an upper side of the belly and the neck between the first and second attachments, a folding arrangement connecting the neck and the belly to permit the neck to be folded between a first operative position and a second inoperative position in which the neck is located above the upper side of the belly in the inoperative position, one of the string attachments comprising a reel rotatably journalled about a shaft located substantially perpendicular to the alignment of the extended strings, and the reel is spring-tensioned about the shaft in order to coil or uncoil the strings in a stretched state when the neck is folded from or to the first operative position a fitting carrying the reel, an element rigidly secured to the belly, a tensioning mechanism between the fitting and the element, the tensioning mechanism having an end position at which the tensioning mechanism holds the fitting at a predetermined distance from the element and which permits an increase in the predetermined distance in order to relieve the strings when the neck is being folded to and from its first operative position.

3. A stringed instrument as claimed in claim 2, wherein the tensioning mechanism comprises a tightening screw with a knob, the screw extending substantially in the direction of the strings and through an opening in one of the element and the fitting, and the screw engaging with an inner thread in the other of the element and the fitting.

4. A stringed instrument as claimed in claim 2, wherein the tensioning mechanism has a clamped end position defined by a rigid contact between the fitting and the element.

5. A stringed instrument as claimed in claim 1 wherein the folding arrangement comprises a four-link mechanism.

6. A stringed instrument as claimed in claim 5, wherein the four-link mechanism comprises a link-that is rigidly joined to the neck and the link has parallel recesses along the neck for receipt of coinciding mechanism links to enable the coinciding mechanism links to be oriented substantially parallel when the instrument is in its unfolded, operative state.

7. A stringed instrument as claimed in claim 6, wherein the screw extends from a lower side of the belly up to a recess for a connecting end portion of the neck and in that the end portion of the neck has a threaded opening to receive a free end of the screw when the neck is fully folded out.

8. A stringed instrument as claimed in claim 1, wherein one of the string attachments is provided with a tuning device for tuning the strings.

9. A stringed instrument as claimed in claim 8, wherein the reel includes recesses open towards an envelope surface of the reel, for a pair of links journalled on the reel to be swung in a radial plane to the reel, the links having outer ends that carry a pivotable attachment bar for adjacent ends of a group of the strings and the envelope surface of the reel includes a recess for the attachment bar when the reel is rotated by the coiling spring when the neck is folded in over the body.

* * * * *